United States Patent [19]

Moffitt et al.

[11] 4,112,250

[45] Sep. 5, 1978

[54] TERMINAL FOR ELECTRICAL COMPONENT AND METHOD OF MAKING SAME

[75] Inventors: Jerry T. Moffitt, Muskego; Robert W. Bulgrin, Fort Atkinson, both of Wis.

[73] Assignee: Allen-Bradley Company, Milwaukee, Wis.

[21] Appl. No.: 800,680

[22] Filed: May 26, 1977

[51] Int. Cl.[2] ..... H01C 1/14

[52] U.S. Cl. ..... 338/322; 338/314; 338/307; 338/308; 29/621

[58] Field of Search ..... 338/162, 312, 322, 326, 338/174, 332, 323, 324, 325, 329; 339/220 R, 220 T; 29/621; 174/68.5

[56] References Cited

U.S. PATENT DOCUMENTS

| | | | |
|---|---|---|---|
| 3,562,700 | 9/1969 | Miller | 339/220 R |
| 3,855,565 | 12/1974 | Robinson et al. | 338/174 |
| 3,947,800 | 3/1976 | Van Benthuysen et al. | 338/174 |

FOREIGN PATENT DOCUMENTS

| | | | |
|---|---|---|---|
| 809,419 | 2/1959 | United Kingdom | 338/324 |

*Primary Examiner*—J. V. Truhe
*Assistant Examiner*—J. H. Bouchard
*Attorney, Agent, or Firm*—Arnold J. Ericsen

[57] ABSTRACT

An electrical circuit component includes an apertured, relatively flat substrate having a circuit deposited on a surface and with a terminal lead member lying along one of the opposed surfaces of the substrate with the inboard end of the lead having a supporting body portion and an integral portion offset with respect to the body portion. The lead includes a plurality of integral laterally extending projections, at least one of which projects from the body portion and the other of which projects from the offset portion of the lead member. The lead projections are inserted in respective apertures and are upset at their distal end portions to provide clamping retention and electrical continuity between the lead body portion and the substrate with its deposited circuitry.

5 Claims, 9 Drawing Figures

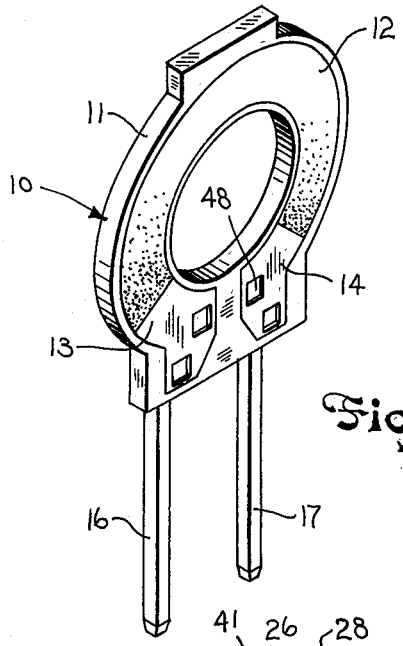
Fig. 1
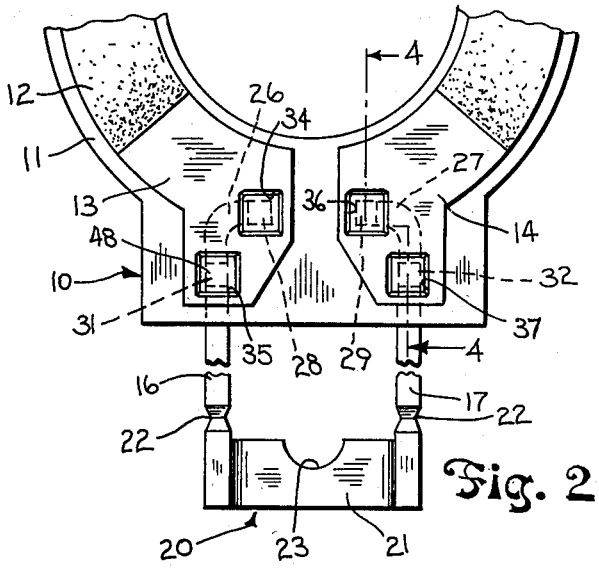
Fig. 2
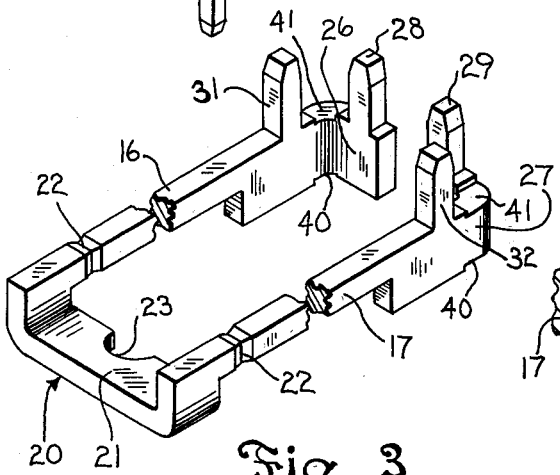
Fig. 3
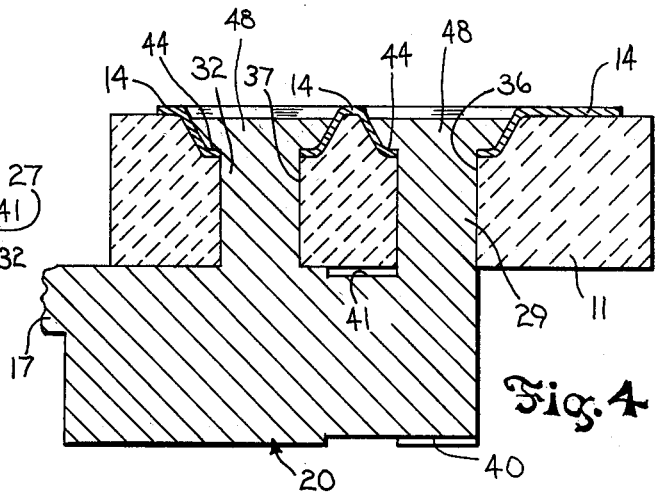
Fig. 4
Fig. 5
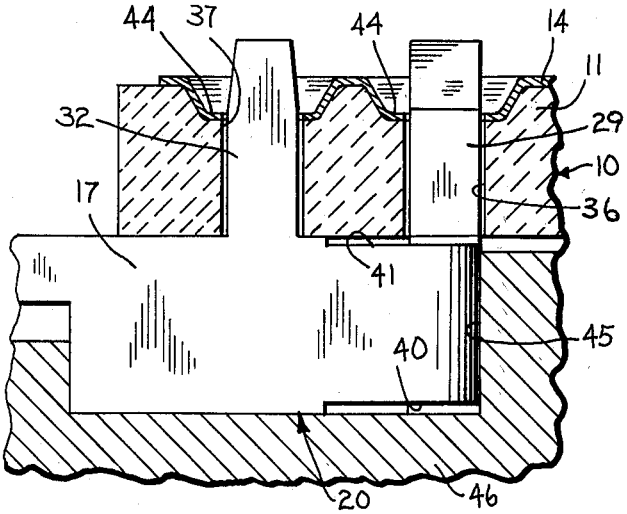
Fig. 6
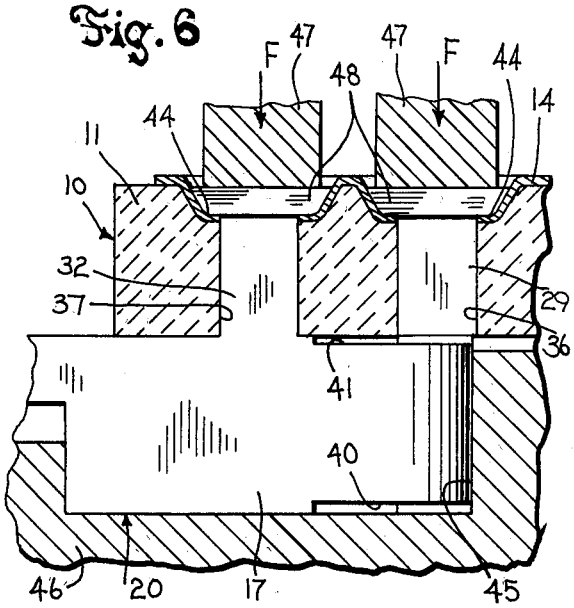

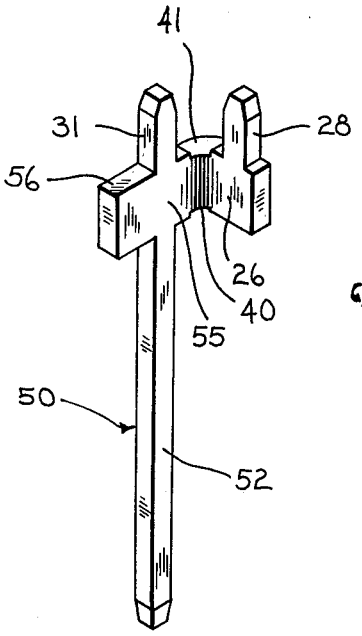
Fig. 7
Fig. 8
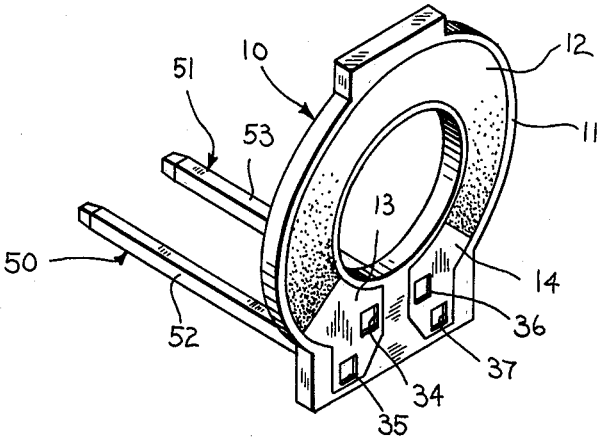
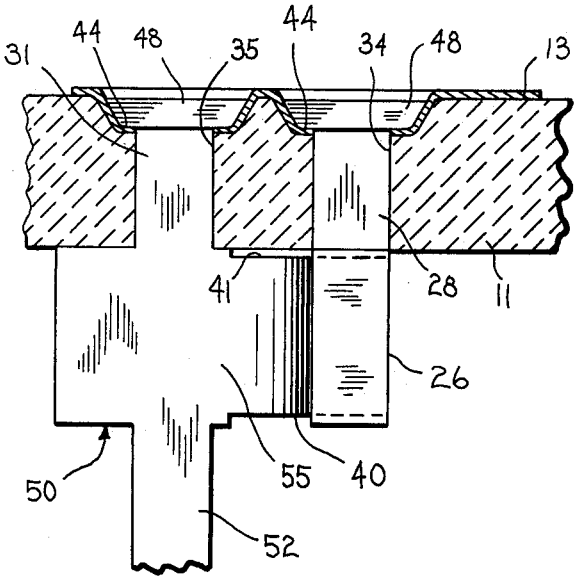
Fig. 9

TERMINAL FOR ELECTRICAL COMPONENT AND METHOD OF MAKING SAME

BACKGROUND OF THE INVENTION

This invention relates to the art of electrical circuit component manufacture and, more particularly, to improved means, including both the article and method, for anchoring terminal leads or pins to a substrate and a circuit component supported by the substrate.

The increasing need for miniaturization of electrical components and the forming of electronic packages therefor has dictated the requirement for suitable substrates or bases upon which the components and circuits may be disposed. Obviously, care is required in the selection of terminals and leads for mechanically interconnecting the components and the circuits. Very often, the insulating substrates for supporting the circuits are of relatively fragile or frangible materials such as alumina or other ceramic materials. This is particularly true in the case of components utilizing electrical circuitry of the so-called "cermet" or thick film or even thin metallic or carbonaceous film materials disposed upon a substrate capable of being fired to join the film with the substrate. Obviously, it is advantageous to utilize a minimal thickness of substrate, which also tends to add to the weakness of construction.

Typically, terminal leads have been attached to a substrate to provide an electrical connection to a circuit layer, such as a resistor or other conductive film deposited on the substrate, by means of soldering, mechanical crimping or by force fitting the leads into cavities formed in the substrate.

The field of the present invention is directed to the attachment of leads to a substrate bearing a conductive circuit and, particularly, to those terminal leads having a portion thereof protruding through an aperture in the substrate and adapted to be swaged or otherwise upset by applying a force directly to the end of the portion of the lead member. This force forms a laterally extending flange-like portion for clamping engagement with the lead surface positioned on opposite sides of the apertured substrate. Examples of prior art devices utilizing swaging or upsetting methods of attaching leads may be found in U.S. Pat. Nos. 2,717,943 granted to Daily et al. on Sept. 13, 1955; 3,257,708 granted to Stricker on June 28, 1966; 3,537,056 granted to Van Benthuysen et al. on Oct. 27, 1970 and 3,659,245 granted to Payne on Apr. 25, 1972. British Pat. No. 737,998, published Oct. 5, 1955 and invented by E. J. Madle, also shows means of joining leads to substrates.

In general, although attachment techniques utilizing swaging or upsetting procedures have contributed to an inexpensive and facile method of manufacturing miniaturized devices, these same techniques have also required close control, specific attention to alignment of tooling and close attention to manufacturing tolerances of the mating parts. This degree of control obviously has led to a relatively high "scrap rate". In the case of devices such as the resistance units of potentiometers and circuit trimming devices, as well as network substrates, the resistive elements will have previously gone through several stages of manufacture prior to attachment of termination leads. Should the devices at this stage become damaged, it will be apparent that their inherent value will be relatively high and that it is even more important to minimize scrap at this point of manufacture. When devices are miniaturized, it will be obvious that the size of the substrate must be kept to a minimum — a requirement that limits the stress-bearing cross section of the substrate. Successful swaging or upsetting operations therefore require that the component parts be specifically designed for stress-bearing efficiency.

SUMMARY OF THE INVENTION

It is with the above problems and considerations in mind that the present improved electrical component and method of termination for securing a conductive terminal lead to an electrical circuit disposed on the substrate have evolved in a manner that will materially reduce the scrap rate and provide a component part design with certain design features that may be used to maximize stress-bearing efficiency.

Terminal leads, pins or lugs of the present design may be conveniently preformed by means of conventional lead frame techniques or may be individually made, and preferentially grouped in matched pairs for ease in handling during assembly and adaptation for simultaneous upsetting or swaging of projecting portions of each lead member. In one embodiment of the invention, the terminal pins lie in a plane parallel to the general plane of the substrate, thereby providing a construction wherein the substrate may be mounted normal to a panel without requiring subsequent bending and forming. Bending of the pins obviously places unnecessary stress on the relatively fragile substrate. That is, each lead member extends laterally beyond the termination end of the substrate and has at its inboard end upwardly projecting portions for insertion into apertures in the substrate which portions are subjected to the action of the upsetting or swaging tool.

In another embodiment, the lead members may be formed to provide a configuration with the terminal pins extending normal to the flat substrate without requiring additional stress inducing after bending and forming.

In order to provide additional attachment strength and distribution of stresses during swaging, the lead members are preferably formed with a supporting body portion and an integral portion being offset with respect to the body portion. Also, by supplying two offset apertures, the tolerance of the apertures may be relieved, since a single aperture does not have to take the full sidewise thrust that might be exerted on the lead member. Additionally, the apertures may be of a rectangular or square configuration which serves as a further retaining means for the projections having a similar cross section and extending from the main lead body.

BRIEF DESCRIPTION OF THE DRAWINGS

FIG. 1 is a perspective view of a resistive element utilizing pin-type terminal lead members joined to the substrate and deposited termination layer of a first described embodiment made in accordance with the practice of the present invention;

FIG. 2 is a fragmentary front elevational view of the terminated element of FIG. 1, and greatly enlarged to illustrate the components of the present invention;

FIG. 3 is a perspective view of a preformed terminal subassembly prior to being seated within the apertures of the substrate supporting the resistive element of FIGS. 1 and 2;

FIG. 4 is a sectional view taken along lines 4—4 of FIG. 2;

FIG. 5 is a fragmentary elevational view, partially in section, illustrating the terminal lead subassembly and the substrate in an upsetting tool just prior to swaging of the upstanding lead projections;

FIG. 6 is a view similar to the view of FIG. 5, but showing application of the upsetting punch during final deformation of the projecting portions of a terminal lead member and in clamping engagement with the substrate and its deposited electrical circuitry;

FIG. 7 is a perspective view of a preformed terminal subassembly of a second described embodiment prior to being seated within the apertures of a substrate;

FIG. 8 is a perspective view, similar to the view of FIG. 1, but with the termination utilizing the embodiment of the preform illustrated in FIG. 7; and FIG. 9 is a fragmentary elevational view, partially in section, illustrating the assembled relationship of the preform subassembly and substrate of the embodiment of FIGS. 7 and 8.

DESCRIPTION OF PREFERRED EMBODIMENTS OF THE INVENTION

A first preferred embodiment is disclosed in FIGS. 1–6, inclusive, and provides a means of termination for an electrical component, in the form of a resistive element, indicated generally by the reference numeral 10. The specific element 10 shown is disclosed merely for purposes of illustration and is of the type more specifically disclosed and described in U.S. Pat. No. 3,676,822 granted to James E. Slagg et al. and assigned to the same assignee as the present invention. In that patent, however, it will be observed that the configuration of the resistive element is of a molded plastic material supporting a hot molded carbon composition resistive layer, and utilizes a molded insert terminal construction. It will be readily apparent to those skilled in the art that elements utilizing a ceramic substrate for supporting resistive material may be substituted when conditions require. Both described embodiments, for purposes of illustration, utilizes an insulating substrate 11, which may be of alumina or other ceraminc or glass materials and having deposited on at least one surface thereof a resistive layer 12, opposite ends of which overlay termination pads 13 and 14. The resistive layer 12 may be of the so-called "cermet" material prepared in conventional manner by selecting a glass frit intermixed with conducting metals or oxides of metals to provide desired resistive characteristics. The termination pads 13 and 14 may also be made from a deposited layer of glass frit with a heavier concentration of conductive materials, or may simply be a printed and fired silver layer when conditions permit. The substrate 11 and layers 12, 13 and 14 are all assembled and fired to preselected conditions before assembling the termination pins 16 and 17, which respectively electrically and mechanically engage termination pads 13 and 14. These termination pins may be of the construction shown or may be of conventional lug-type terminals (not shown).

With reference to FIGS. 2 and 3, it will be observed that a generally U-shaped subsassembly, indicated generally by the reference numeral 20, includes a lead member having termination pins 16 and 17 lying in parallel planes and projecting laterally from a transversely arranged cross-support member 21. The subassembly 20 is handled as a unit, and after termination steps have been completed, the cross-support 21 may be broken away from the extending pins 16 and 17 at the juncture 22 with the pins standing free as shown in FIG. 1. The cross-support is notched at 23 for purposes of alignment in a supporting slide fixture to be later described.

It will be apparent from the various figures that each of the pins 16 and 17 is respectively formed at its inboard end to provide a bent right angle offset portion 26 and 27, respectively. This offset provides additional support during upsetting operations, as well as a convenient and stable clamping surface. This also eliminates the need of preheading a terminal pin intermediate its ends in accordance with past practice. Portions 26 and 27 terminate in upstanding integral portions 28 and 29, respectively. Additional upstanding projections 31 and 32 are integrally formed as part of the pins 16 and 17, respectively. It will be noted that the distal ends of each of the projections 28 and 29 and 31, 32 are tapered to provide ease in insertion of the respective projections into the apertures 34, 35 and 36, 37 of the substrate 11. The offset portions 26 and 27 are preferably formed as a right angle bend as shown, but it is within the province of this invention to provide an offset portion (not shown) of curvate or other configuration spaced inwardly from either end of the respective pins 16 and 17.

It will be observed that the pins 16 and 17 are relieved at the surfaces 40 and 41 to permit ease in bending during the mechanical forming operations when fabricating the subassembly 20. It is also to be noted that the upper surfaces of the apertures 34, 35 and 36, 37 are tapered inwardly, and further define shoulders 44 in their respective apertures as an additional locking feature for retaining the upset or swaged projections 28, 29 and 31, 32.

With the above description in mind, it will be observed from FIGS. 5 and 6 that the subassembly 20 is disposed in a cavity 45 of a supporting fixture 46 preparatory to receiving the substrate 10. The substrate 11 is disposed with each of its various apertures fitted over the respective terminal pin projections. The fixture 46 may be slidable and directed by guideways (not shown) directly under a swaging tool having male punches 47 which are forced downwardly with respect to FIG. 6 by force F, and which are designed to form the upset head portion 48 on each of the respective projections 28, 29 and 31, 32 as shown in FIGS. 4 and 6. It will also be apparent that the remaining portions of each projection may be "bulged" to fill its respective aperture 34, 35, 36 and 37. However, the preferred square or other polygonal aperture cross-section has been chosen to lessen the need of bulging as used in devices with round pins fitting into round holes. The latter require considerable attention to tooling requirements and other tolerance measurements. The upsetting or swaging operation provides a tight fit with extra locking action provided by means of the shoulders 44 and the substrate 11. As previously stated, the tolerance of the cross-sectional dimensions of the pins and of their respective apertures may be relatively loose when compared to conventional swaged pin terminal constructions. The plurality of apertures retaining the projections on each pin add additional holding area and provide additional support to the pin when compared to conventional double headed swaged pins with all of the upsetting force being applied in only an axial direction.

The additional surface area provided by the respective offset portions 26 and 27 distribute the force F to a broad area of the body portions of the respective pins 16 and 17 from which the projections 28, 29 and 31, 32 extend, so that all of the force is not disposed at one stress-bearing position. The preferred first embodiment also includes polygonal or square shaped apertures in the substrate, although other cross-sectional configurations will not depart from the present invention. It is usual to "radius" the sharp corners of the polygonal apertures to permit ease in manufacture of the fired substrate 11. In addition, it will be noted from FIGS. 1 and 2 that the termination areas 13 and 14 have been deposited to cover each of the respective apertures 34, 35, 36 and 37, whereas in certain cases, it may be sufficient to cover only one aperture for good contact. In the present case, the additional contact with both apertures and their respective pin projections provide a redundancy which insures a more positive electrical connection.

It will be apparent that the present inventive concept will also encompass the second embodiment illustrated in FIGS. 7, 8 and 9, wherein the lead members are identified generally by reference numerals 50 and 51. In the present embodiment, the members 50 and 51 are inserted into the respective apertures 34, 35 and 36, 37 in the substrate 10. (It is to be noted that the same reference numerals are used to identify like elements in both of the described embodiments.) The terminal pins 52 and 53 of lead members 50 and 51 of the present embodiment project substantially normal to the relatively flat substrate 10. Thus, the terminal leads of both embodiments may be supplied directly to the specifications of the ultimate user without requiring additional bending to final form. Although, in some instances where quantity does not permit, the lead members may be bent after assembly and upsetting without departing from the scope of the invention.

With reference to FIG. 7, it will be apparent that the lead member 50 utilizes a pin construction, wherein the pin 52 extends downwardly with respect to FIG. 7, as opposed to extending laterally, as illustrated by pin 16 of the construction of FIG. 3. The pin 52 is shown slightly offset relative to the projection 31, but it is within the province of this invention to position the pin at any of several positions along the surface configuration of the lead body 55. A preferred construction, as shown, includes a supporting, laterally extending portion 56 of the lead body 55 to provide added support and clamping surface cooperating with the swaged or upset projections 31 and 28.

The preferred embodiments depict components, wherein a resistive layer and an overlying termination layer are deposited on a substrate prior to swaging or upsetting the respective lead members. However, it is contemplated that when the occasion demands, the terminal lead members 20 and 50 may be preassembled and swaged to the respective substrates 11 prior to deposition of film type circuitry. That is, a termination layer (not shown) may be deposited on the substrate and over the pre-headed portion of the respective projections 28, 29 and 31, 32. This may be accomplished by conventional sputtering, vacuum deposition and other techniques which would not require firing at a temperature that might deleteriously affect the metal terminal members.

The embodiments of the invention in which an exclusive property or privilege is claimed are defined as follows:

1. A method of attaching a terminal lead member to an apertured, relatively flat, ceramic substrate having oppositely disposed surfaces, at least one of which supports a deposited electrical circuit layer, and wherein the apertures extend through the substrate and intersect each of said surfaces, said method comprising the steps of:

forming an elongated terminal lead member with a body portion, a lead portion extending outwardly of said substrate and lying in a plane substantially parallel with the plane of the circuit supporting layer of said substrate, and an integrally formed portion bent angularly relative to said body portion, a plurality of integrally formed, spaced apart projections each extending laterally relative to said terminal lead member, at least one of said projections being formed in said angularly bent portion and at least one of said projections being formed in said body portion;

inserting the projections of said lead member into respective substrate apertures with the said body portion and the said angularly bent portion each lying adjacent to the surface oppositely disposed from said circuit layer supporting surface of said substrate and with the distal end of each of said projections extending through their respective apertures beyond the circuit layer supporting surface of said substrate; and applying an axially directed force to said projections to upset the respective extended distal ends thereof to laterally distend the ends for clamping engagement with said substrate.

2. The method of claim 1, wherein the said lead portion is formed to lie in a plane substantially normal to the plane of the said body and angularly bent portions of said terminal lead member.

3. In an electrical circuit component comprising a relatively flat ceramic substrate having opposed parallel surfaces, at least one of said surfaces supporting a deposited electrical circuit layer, said substrate further including apertures extending therethrough and intersecting said surfaces; the combination with a terminal lead member disposed adjacent to one surface of said substrate, said lead member having a body portion, a lead portion extending outwardly of said substrate and lying in a plane substantially parallel with the plane of the circuit supporting layer of said substrate, and an integral end portion bent angularly relative to said body portion, said body and angularly bent portions lying in a plane substantially parallel with the substrate surface, said terminal lead member further including integrally formed projections inserted in respective apertures of said substrate, at least one of said projections extending laterally from said angularly bent portion and at least one of said projections extending laterally from said body portion, the distal ends of the projections on said lead member being upset in an axial direction to clampingly engage said substrate and said body and angularly bent portions of said terminal lead member.

4. The component of claim 3, wherein the body and angularly bent portions of said lead member are disposed adjacent to and substantially parallel with the surface opposite the circuit component supporting surface of said substrate, and the respective upset ends of said projections and the body and angularly bent portions of the lead member clampingly engage the substrate positioned therebetween.

5. The component of claim 3, wherein the lead portion lies in a plane substantially normal to the plane of the said body and angularly bent portions of said substrate.

* * * * *